US005100482A

United States Patent [19]

Tanaka et al.

[11] Patent Number: 5,100,482

[45] Date of Patent: Mar. 31, 1992

[54] METHOD OF PREPARING A LEAF SPRING

[75] Inventors: Tadanori Tanaka, Yachiyo; Masao Nakamura; Toshifumi Yamada, both of Shisui; Katuhyosi Takase, Tokyo; Kazuhiro Muramatsu, Kamagaya; Tosikazu Ebata, Funabashi, all of Japan

[73] Assignee: Horikiri Spring Mfg., Co., Ltd., Yachiyu, Japan

[21] Appl. No.: 402,472

[22] Filed: Sep. 5, 1989

[51] Int. Cl.[5] ..... C21D 8/00

[52] U.S. Cl. ..... 148/12.4; 148/12 R; 148/908

[58] Field of Search ..... 148/908, 131, 130, 12 B, 148/12 R, 12.4; 29/173

[56] References Cited

U.S. PATENT DOCUMENTS

| | | | |
|---|---|---|---|
| 3,345,727 | 10/1967 | Komarnitsky | 29/173 |
| 3,668,917 | 6/1972 | Komatsu et al. | 29/173 |
| 4,193,824 | 3/1980 | Egorov et al. | 148/12.4 |

*Primary Examiner*—Deborah Yee

*Attorney, Agent, or Firm*—Fleit, Jacobson, Cohn, Price, Holman & Stern

[57] ABSTRACT

A method of preparing a leaf spring having a heating step in which a raw material of a leaf spring is heated to austenite range temperature, a rolling step in which the above heated material is formed to a desirable shape, a working step in which the above rolling material is cut to a fixed length to form a chip hole, a bolt hole or the like, and a cooling step in which a camber is given to the above working material to cool to hardening in his state.

Other five modified methods are also described.

12 Claims, 4 Drawing Sheets

METHOD OF PREPARING A LEAF SPRING

BACKGROUND OF THE INVENTION

This invention relates to a method for manufacturing leaf such as laminated springs for automobiles.

At present, leaf springs for automobiles are required to be lighter along with the requirement for lighter automobiles. In the laminated spring, if the achievement of this object is intended only by decreasing the weight without considering the material quality, the durability and fatigue resistance of the leaf spring decreases in proportion to the weight reduction. In order to carry out the reduction of weight it has been attempted to improve hardness of the laminated leaf springs.

However, simply improving hardness of a leaf spring has decreased its tear and impact resistances sometimes shortening the useful life of the spring because of unexpected tear due to impact caused by hard objects such as stones. Accordingly, the improvement of hardness of leaf springs does not offer any solution for reduction of weight.

Then a heat treatment called "ausforming process" or "modified ausforming process" has been applied. In this case, the ausforming process means a heat treatment wherein a raw material of leaf springs is hardened in a hot bath at 300° C. to 600° C. after being heated up to a temperature in the austenite range, then rolled after the temperature of the material has become stable and then quenched so as to obtain fine martensitic microstructure. The modified ausforming process is a heat treatment wherein a raw material is rolled after being heated up to the austenite range temperature and suddenly quenched in an oil bath so as to obtain a fine martensitic microstructure.

In these heat treatment processes, leaf springs resisting against tear and impact have been obtained, but these quenching processes have to be applied soon after being rolled. However, the raw material is hardened so much that an eye forming operation and clip hole and center hole drilling operation become inapplicable or extremely difficult after being quenched, thereby sacrificing productivity.

In this case, only a drilling operation with a bit is applicable for drilling through holes for fixing a center bolt, a plurality of leaf spring and clips, but the drilling operation is impossible because of the hardness. Accordingly, the ausforming process and the modified ausforming process have not been sufficient as a method for manufacturing leaf springs.

BRIEF DESCRIPTION OF THE INVENTION

The object of this invention is to provide a method of manufacturing leaf springs which ensures sufficient productivity, durability, fatigue resistance, and resistance against tear and impact.

In order to obtain the above object, this invention provides a method of manufacturing a leaf spring wherein such working processes as the formation of eye portion, piercing a clip hole and a bolt hole, cutting for control of a length or bending at the top end between the rolling work and hardening of the conventional modified ausforming.

This invention is characterized by the following construction.

A first process is characterized by a heating step wherein a raw material of a leaf spring is heated to austenite range temperature, a rolling step, wherein the above heated material is rolled in the width and thickness directions, a working step wherein the rolled material is cut to a fixed length to form a clip hole, or a bolt hole for example, and a cooling step wherein a curvature is formed on the above working material by using dies and quenching the worked material by dipping in quenching liquid in this state.

A second process is characterized by a heating step wherein a raw material of a leaf spring is heated to an austenite range temperature, a rolling step wherein the above heated material is rolled in the width and thickness directions, a working step wherein the top end of the above rolled raw material is bent in order to form eyes or so called military wrapper and form a clip hole or a bolt hole by cutting the rolled material to a desirable length, and a cooling step which forms a curvature on the worked material by using dies and to harden it by dipping in quenching liquid.

A third process is characterized by a first heating step wherein a raw material of a leaf spring is heated to austenite range temperature, a rolling step wherein the heated raw material is rolled in the width and thickness directions, a working step wherein the above rolled material is cut to a determined length to form a securing hole for a clip, or a bolt hole, a second heating step wherein the above worked material is reheated to a stable austenite range temperature in a heating furnace, and a cooling step wherein a curvature is formed by using dies on the second heated material and then quenching in this condition.

A fourth process is characterized by a first heating step wherein a raw material of a leaf spring is heated to austenite range temperature, a rolling step wherein the heated material is rolled in the width and thickness directions, a first working step wherein the top end of the above rolling material is bent for formation of an eye portion rolling to form a bolt hole of the like by cutting it at a desirable length, a second heating process wherein the above working material is reheated to austenite range temperature in a heating furnace, a second working step wherein eyes are formed on both ends of the second heated material, and a cooling step wherein a curvature is formed on the raw material by using dies and hardening by dipping in quenching liquid.

A fifth process is characterized by a first heating step wherein a raw material of a leaf spring is heated to an austenite range temperature, a rolling step wherein the above heated material is rolled in width and thickness directions, a first working step wherein the rolled material is cut to a desired length to form a hole for securing a clip, or a bolt hole, a second heating step wherein the above worked material is reheated to a stable austenite range temperature, a second working step wherein the above reheated material is bent into a predetermined shape, a third heating step wherein the second worked material is reheated, and a cooling step wherein a curvature is formed by using dies and the heated material is hardened by dipping in a quenching liquid.

Further, a sixth process is characterized by a first heating step wherein a raw material of a leaf spring is heated to austenite range temperature, a rolling step wherein the above heated material is rolled in the width and thickness directions, a first working step wherein the top end of the above rolling material is bent to form an eye rolling shape by cutting it to a desirable length and forms a hole for securing a clip, a bolt hole or the like, a second heating step wherein the above working material is reheated to a stable austenite range temperature, a second working step wherein the rolling of the eye portion of the reheated material is performed, a third heating step wherein the above second working material is reheated to a stable austenite range temperature, and a cooling step wherein a curvature is formed by using dies on the material and a hardening is performed by dipping in quenching liquid.

DETAILED DESCRIPTION OF THE PREFERRED EMBODIMENTS

The detailed description of the invention will be explained as follows.

Figure 1:
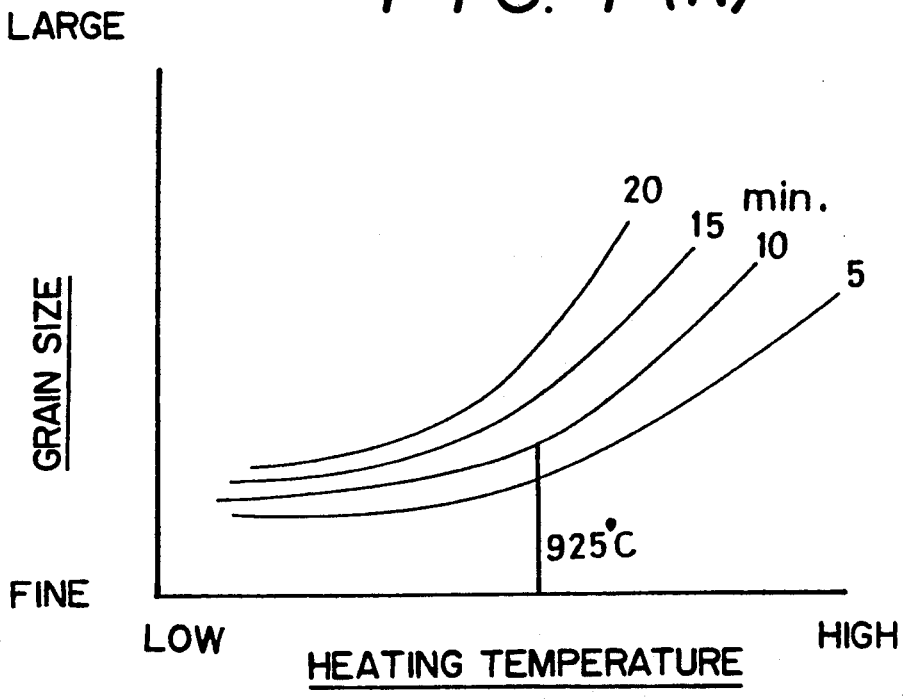
FIGS. 1(A) and (B) are graphs which illustrate the influences of the heating temperatures in the heating steps of this invention.
Figure 1:
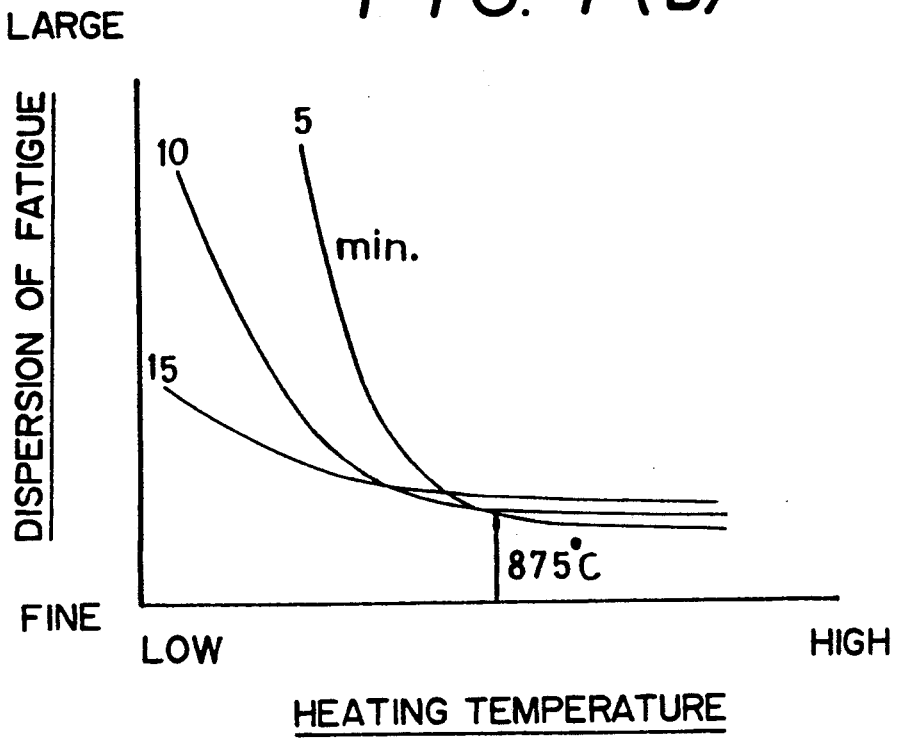

First, the first and second processes will be described. Steel materials such as spring steel, stainless steel and the like already cut to determine length are used as raw materials of the leaf spring, especially SUP-10 system steels improved the hardenability by increasing the amount of additive on SUP-10 or SUP are desirable. The heating temperature in the heating step is held at an austenite range temperature, but desirable temperature is 900° C.±25° C. This is because when the heating temperature 925° C. is more than 10 minutes of heating times as shown in FIGS. 1(A) and (B), the growth of grain size of the material becomes fast suddenly, which causes not to obtain fine crystals, while if the heating is not performed for more than five minutes at 875° C., the removal of segregation and inner strains of the material and the formation of the solid solution of the components are not performed sufficiently whereby the fatigue strength of the leaf spring are dispersed.

Since the surface of the heated material in heating step is adhered with oxide scale, this may be removed with descaler of water jet.

Figure 2:
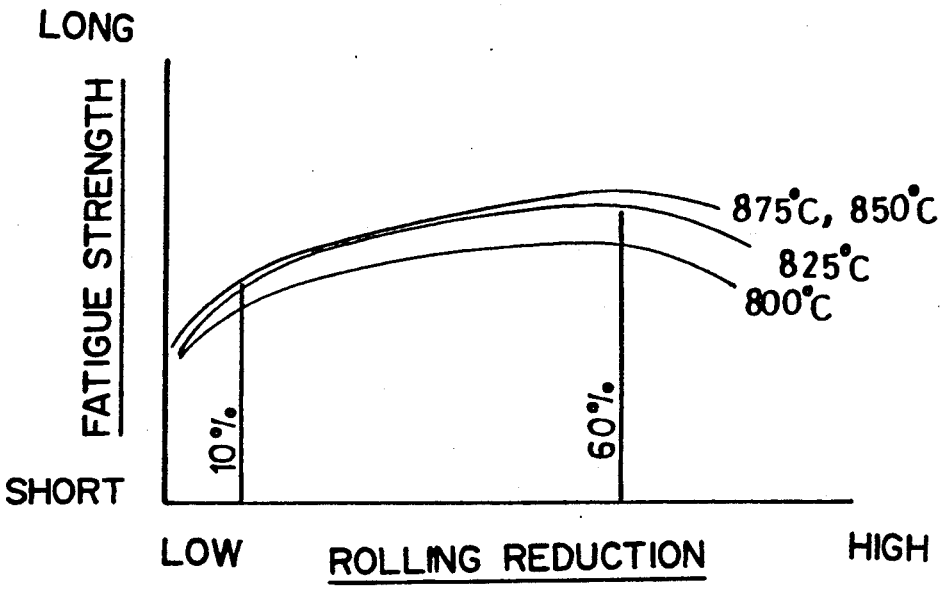
FIGS. 2(A) and (B) are graphs which illustrate the influences of the rolling reduction in the rolling step and of the cooling times after rolling.
Figure 2:
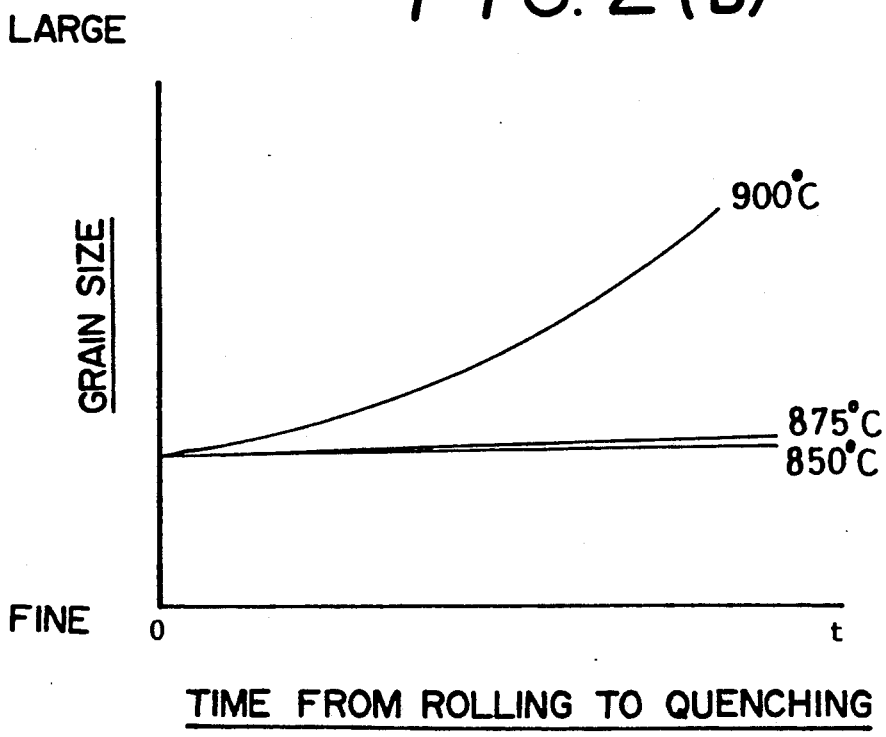

In the rolling step, the rolling in two directions, width and thickness directions of material are performed by a suitable rolling roll. The temperatures of the material at this time are desirable 870° C.±25° C. in width direction rolling and 850° C.±25° C. in thickness direction rolling respectively. Further, the roll reduction in thickness direction is desirable to be 10 to 60%. The reason is because the rolling in the plate thickness direction is, as shown in FIGS. 2(A) and (B), out of range 10 to 60% of the rolling reduction, or if the treatment temperature is less than 825° C., the fatigue strength of the leaf spring decreases suddenly, while if it is more than 875° C., the restoration of the grain size of the material becomes fast and the grain size thereof becomes larger rapidly.

Further, in work step, the working is performed according to leaf springs of various kinds to be a final product. There are some which do not need eye forming work and hole piercing work such as clip hole, bolt hole and the like. At this time, only a cutting working which cuts the material to a fixed length is performed for trimming the length of the top end thereof. Since this step is set up before the hardening step, the hardness of the material is low thereby being able to practice the above steps easily.

Figure 3:
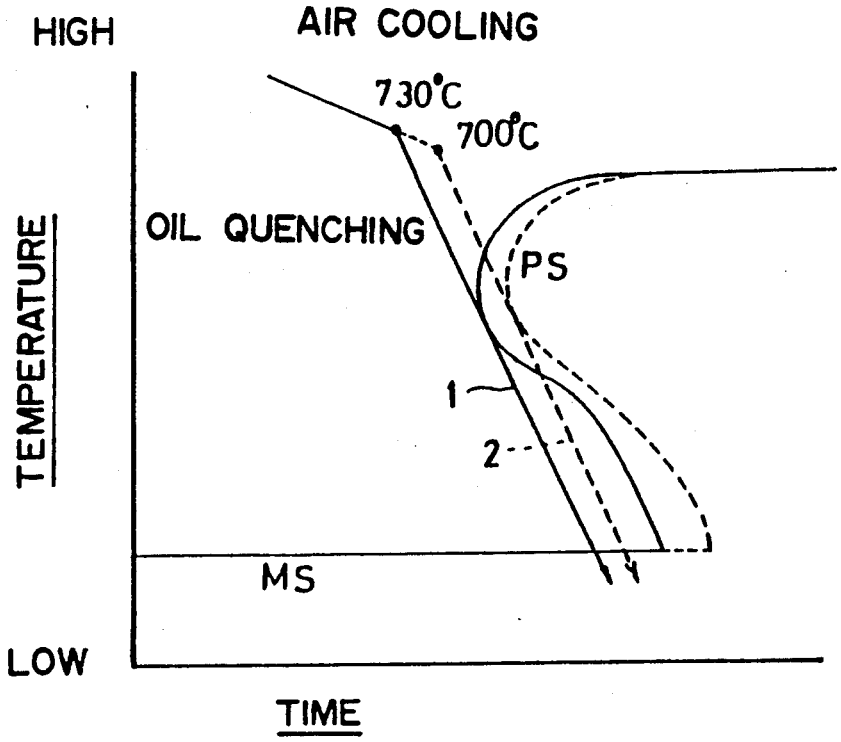
FIG. 3 is a graph which shows relations between cooling times and temperatures in the cooling step of this invention.
Figure 4:
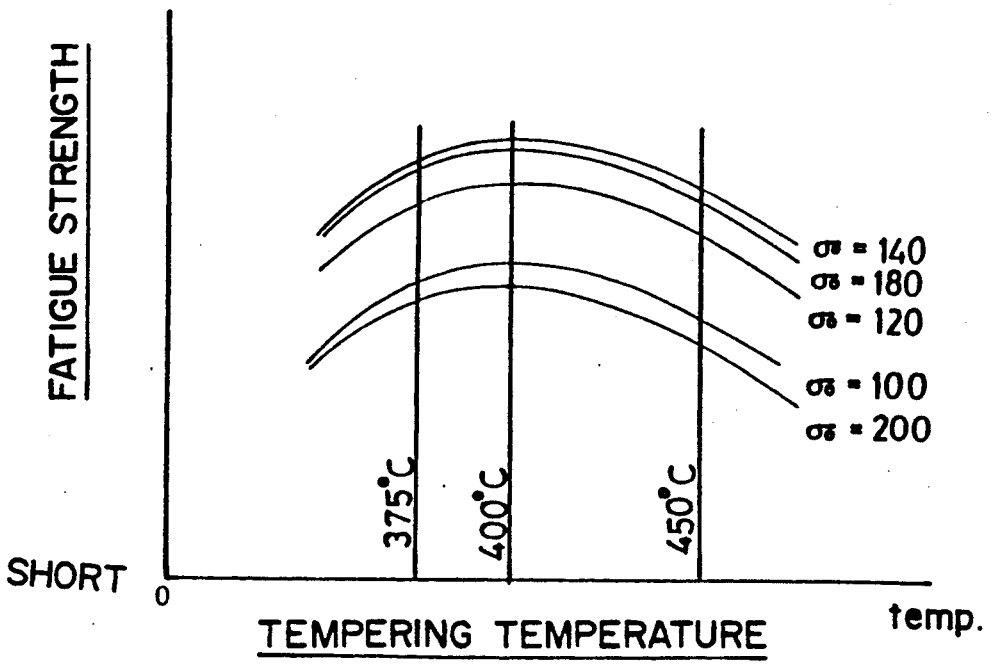
FIG. 4 is a graph which shows relations between the tempering temperatures and the life of the leaf spring, and between the initial stresses and life of the leaf spring.

In the next cooling step, oil hardening or water hardening is performed in a state where a curvature is formed on the material soon after the practice of the above steps. In this case, if well hardenable alloy in aging is used, air cooling may be used. In this cooling step, when illustrated the oil hardening, it goes through a hardening process shown by a S-curve in FIG. 3 by dipping in oil. In FIG. 3, a solid line indicated of the numeral 1 shows a hardening process of this invention, while a broken line of the numeral 2 shows a cooling process, wherein a material is once cooled by air to room temperature after rolling, heated up to the austenite range temperature again, then cooled to 700° C. by air and subjected to an oil hardening. As understood from this drawing, the material cooled by air (numeral 2) after reheating can be obtained a sufficient martensite is obtained even by oil quenching after air cooling at 700° C. However, in this invention (numeral 1), since the nose of the S-curve shifts to the left (broken line to solid line), a sufficient structure can not be obtained if the oil quenching is not performed at 730° C. to 820° C. Accordingly, in this invention, it is preferable to perform the hardening before the material temperature becomes less than 730° C. In case of water hardening, a sufficient hardening effect can be obtained at 680° C. to 820° C. since the cooling rate of the water hardening is faster than that of the oil hardening. The hardness of the material increases by this hardening and fine martensite structure can be obtained by performing this quenching process continuously. Such fine martensite structure shows a high toughness by tempering which contributes the increase of the antitearing and antishock resistances. After the hardening step, the final product is made by performing a shot peening or a stress peening treatment in order to give compressive remaining stress to clean the tension surface. At this time, the tempering temperature is desirable to be 400° C.±10° C. This is because the tempering temperature has a peak of life at near 400° C., as shown in FIG. 4, especially the longest life is obtained at 400° C. and 140 $Kg/mm^2$ of initial stress.

The third and fourth processes will be described as follows.

The first heating step and rolling step are respectively the same as that of the first and second processes. In the working step after the rolling step, the working according to the leaf springs of various kinds to be final products are worked as same as the working step in the first and second inventions. In other words, in the third invention such work as cutting the rolled material to a determined length and forming a securing hole for clip, a bolt hole and the like, and in the fourth invention such work as bending work on the ends of material for forming eyes other than the above working are performed.

The next second heating step is a reheating step wherein the air cooled material is reheated to a stable austenite range temperature. This reheating is preferable to be performed before the material temperature becomes less than 730° C. This is because when the material which becomes less than 730° C. is reheated, it necessitates much times to return to the austenite phase even if it is reheated since the ferrite and pearlite are decomposited thereby being unable to obtain fine martensite structure by hardening. A preferable heating temperature in this step is 850° C.±25° C. and times to be exposed at more than 825° C. is less than 1 minute.

The next quenching step is the same as the cooling step in the first and the second processes. However, in the fourth step the eye portion is formed just before the quenching step. The formation of the eye portion is also easy in working since it is performed before hardening.

In steps after steps described above, the shot peening or stress peening is performed through the tempering step continuously to make a product as same as in the first and second processes.

In this invention, a shot peening is performed on the surface of the tension side of the tempered leaf for obtaining specified residual compressive stress therein.

Figure 5:
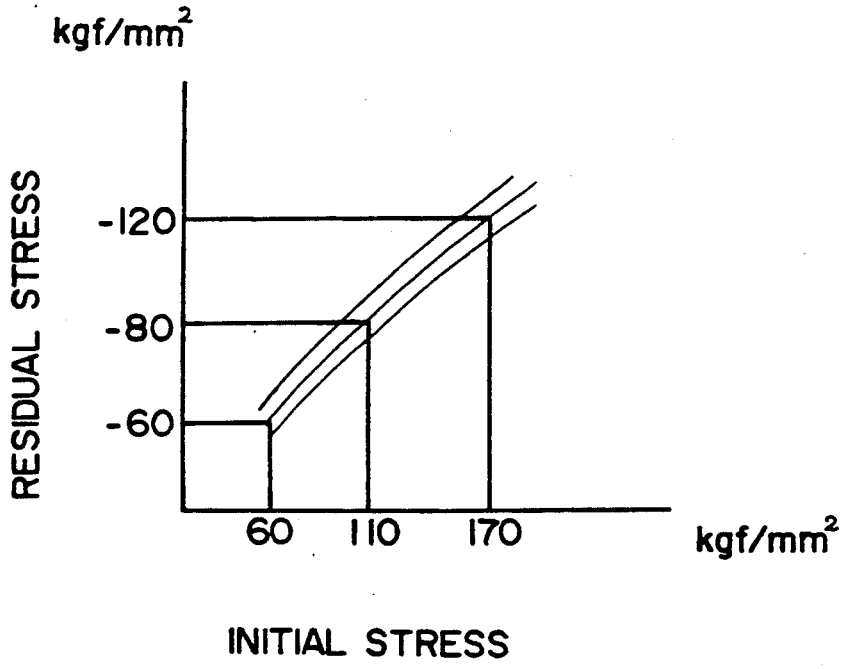
FIG. 5 shows a relation between the initial stresses and the residual stresses.

As shown in FIG. 5, a tempered leaf spring having an initial tensile stress of 120–180 kg/mm$^2$ obtains a higher residual compressive stress after being shot peened.

The fifth and sixth processes now are described as follows.

A first heating step, rolling step and a working step are the same as the first heating step, rolling step and working step (the first working step) in the third and the fourth processes, respectively.

In next second heating step, the heating is performed in the same conditions as in the third and fourth processes. In this case, the air cooled material is reheated to a stable austenite range temperature.

Then, the eye portion or bending is formed in the second working step, said working being easy because of working prior to the quenching. In this case, the bending means a state wherein the leaf spring is bent to a desired shape in accordance with an object used. Although the material is cooled in the second working step, the material is heated by the same condition as the second heating step again in the next third heating step in order to reheat the air cooled material to a stable austenite range temperature.

The next quenching step is the same as the quenching step in the first and second processes. The material is subjected to the same treatment as in the first and second processes in steps after the quenching step. Thus the product is obtained.

OPERATION

Prior to the quenching step wherein the working is easy, the leaf spring material is worked to make an eye portion, a hole for clip and a bolt hole.

The martensitic microstructure is obtained by rolling the heated material in the rolling step.

In the quenching step, the fine grain size maintained till the previous step is fixed to be a martensitic microstructure thereby increasing the hardness of the leaf spring material.

The reheating in the second and third heating step is performed to obtain a normal martensite structure in the quenching step together with making the working easy.

In the product leaf spring, the old austenite crystal grains lessen to JIS#10 to #12, while the antitearing and the antishocking resistances increase.

EXAMPLES

A laminated leaf spring of $8^t \times 70^b \times 1150^l \times 7^p$ in dimension having eye portions for securing car at both ends was manufactured according to the following steps in order and conditions by using the material SUP-10.

Example 1

(1) Heating step

A leaf spring material was heated to 900° C.±25° C. After the temperature of the material having reached 875° C., it was kept for 5 to 10 minutes. After taking out the heated material from the furnace, oxide scale adhered to the surface is removed. Then it is conveyed to the next step.

(2) Rolling step

The material was rolled in the width direction at 870° C.±25° C. of the material temperature and rolled in a plate thickness direction at 850° C.±25° C. under roll reduction of 15%.

(3) Working step

Eye portions were formed at both ends of #1 leaf by using the conventional eye forming machine. Further, #2 leaf and #7 leaf were cut the top end thereof respectively.

(4) Quenching step

The material fed from the prior step was formed a curvature and subjected to oil hardening. The material temperature at this time was 730° C. to 800° C.

Thereafter, the tempering is performed at 400° C.±10° C. of tempered temperature and subjected to stress peening at 140 Kg/mm$^2$ of initial stress.

Example 2

(1) First heating step

The same condition as example 1 - (1).

↓

(2) Rolling step

The same condition as example 1 - (2).

↓

(3) Working step

The top end portion of #1 leaf was subjected to top bending work for forming eyes. The leaves of #2 to #7 were cut at the tip top ends thereof respectively. The material temperature after working was 735° C. to 770° C.

↓

(4) Second heating step

The material was put into the heating furnace to be heated to 850° C.±25° C. for about one minute after temperature of the material having reached 825° C.

↓

(5) Quenching step

The #1 leaf was formed eye portions at both end portions by using a conventional eye forming machine and soon after thereof the oil hardening was performed after forming a curvature. Further, #2 leaf to #7 leaf was subjected to oil hardening after forming a curvature and air cooling. The material temperature at this time 730° C. to 800° C.

The steps after cooling step were subjected to the same treatment as example 1.

Example 3

(1) First heating step

The same conditions as example 1 - (1)

↓

(2) Rolling step

The same conditions as example 1 - (2)

↓

(3) First working step

The same conditions as example 2 - (3)

↓

(4) Second heating step

The same conditions as example 2 - (4)

↓

(5) Second working step

Eye portions were formed at both ends of the material using a conventional eye forming machine. The material temperature after working is 750° C.

↓

(6) Third heating step

The same conditions as the above second heating step.

↓

(7) Quenching step

The same conditions as example 1 - (4)

Thereafter, #1 leaf was obtained by the same treatment as example 1 -(4).

In the present example, other leaves, #2 leaf to #7 leaf which constitute laminated leaf springs respectively were used those obtained by example 2.

Then, comparison tests of the leaf springs obtained by this example 1 with the conventional leaf springs were performed at the same endurant conditions. The results are shown in table 1. The numerals in table 1 indicate repeated numbers until the leaf spring is broken.

The same results are shown in example 2 and 3.

TABLE 1

| samples | useful life (repeated number) |
|---|---|
| this product 1 | 1,338,600 |
| this product 2 | 1,235,297 |
| this product 3 | 1,210,247 |
| conventional product 1 | 181,957 |
| conventional product 2 | 142,721 |
| conventional product 3 | 157,629 |

It will be understood from table 1 that any of this products is longer in life than that of the conventional product corresponding to this product.

Further, the products having 40% less weight than the conventionals according to the present invention were compared with the conventional ones.

As samples, $(8 \text{ to } 13.5^t) \times 70^b \times 1150^l \times 2^p$ of dimension and $8^t \times 70^b \times 1150^l \times 7^p$ of dimension were used in this product and the conventional product respectively. The results are shown in table 2.

TABLE 2

| sample | useful life (repeated number) |
|---|---|
| this product 1 | 321,259 |
| this product 2 | 386,732 |
| this product 3 | 417,253 |
| conventional product 1 | 181,957 |
| conventional product 2 | 142,721 |
| conventional product 3 | 157,629 |

As understood from table 2, even if the weight of this product decreases by 40%, the life longer than that of conventional product is obtained. From this fact, the present manufacturing method can be used to get lighter leaf springs widely.

EFFECT OF THE INVENTION

According to the method for manufacturing leaf springs, a leaf spring having excellent antisettling, antitearing and antishocking properties and a widely extended life can be expected. Accordingly, it is possible to fabricate leaf springs lighter still having a prolonged life.

Further, since various works such as eye formation and piercing a hole for clip or a bolt hole are performed on the material before hardening and the productivity increases.

We claim:

1. A method of manufacturing a steel leaf spring comprising the steps of:

heating a long strip in a continuous furnace for 5–10 minutes at 900° C.±25° C.;

rolling said heated strip successively at 870° C.±25° C. in a width direction thereof thereafter at 850° C.±25° C. in a thickness direction thereof to obtain specified dimensions having reduced thickness in a range of 10%–60%;

cutting, piercing, and stamping successively said rolled strip;

cambering said cut-off, stamped leaf by pressing in specified dies;

quenching said cambered leaf as pressed in said dies in an oil bath of at least 730° C.;

tempering said quenched leaf at a temperature of 400° C.±10° C. immediately after quenching to stabilize said internal structure of said leaf to obtain 120–180 kg/mm$^2$ initial tensile strength;

shot peening the surface of the tension side of said tempered leaf to obtain specified residual compressive stress; and performing said steps of heating to quenching while holding said strip and leaf above said quenching temperature.

2. A method of manufacturing a steel leaf spring having eye-formed ends, comprising the steps of:

heating a long strip in a continuous furnace for 5–10 minutes at 900° C.±25° C.;

rolling said heated strip successively at 870° C.±25° C. in a width direction thereof, thereafter at 850° C.±25° C. in a thickness direction thereof to obtain specified dimensions having reduced thickness in a range of 10%–60%;

cutting said rolled strip producing eye formed ends on both ends of said cut-off leaf, piercing and stamping said eyeformed leaf successively;

cambering said stamped leaf by pressing in specified dies;

quenching said cambered leaf as pressed in said dies in an oil bath of at least 730° C.;

tempering said quenched leaf at a temperature of 400° C.±10° C. immediately after quenching to stabilize said internal structure of said leaf to obtain 120–180 kg/mm$^2$ initial tensile strength;

shot peening the surface of the tension side of said tempered leaf to obtain specified residual compressive stress; and performing said steps of heating to quenching while holding said strip and leaf above said quenching temperature.

3. A method of manufacturing a steel leaf spring comprising the steps of:

heating a long strip in a continuous furnace for 5–10 minutes at 900° C.±25° C.;

rolling said heated strip successively at 870° C.±25° C. i a width direction thereof, thereafter at 850° C.±25° C. in a thickness direction thereof to obtain specified dimensions having reduced thickness in a range of 10%–60%;

cutting, piercing and stamping said rolled strip;

heating, for a second time, said stamped leaf to a temperature of 850° C.±20° C.;

cambering said reheated leaf by pressing in specified dies;

quenching said cambered leaf as pressed in said dies in an oil bath of at least 730° C.;

tempering said quenched leaf at a temperature of 400° C.±10° C. immediately after quenching to stabilize said internal structure of said leaf to obtain 120–180 kg/mm$^2$ initial tensile strength;

shot peening the surface of the tension side of said tempered leaf to obtain specified residual compressive stress; and performing said steps of first heating to tempering continuously.

4. A method of manufacturing a steel leaf spring having eye-formed ends, comprising the steps of:

heating a long strip in a continuous furnace for 5–10 minutes at 900° C.±25° C.;

rolling said heated strip successively at 870° C.±25° C. in a width direction thereof, thereafter at 850° C.±25° C. in a thickness direction thereof to obtain specified dimensions having reduced thickness in a range of 10%–60%;

cutting, said strip, bending both tips of said cut leaf for shaping eyes, piercing said bended leaf successively;

heating, for a second time, said pierced leaf to a temperature of 850° C.±20° C.;

forming eyes on first and second ends of said reheated leaf;

cambering said eye-formed leaf by pressing in specified dies;

quenching said cambered leaf as pressed in said dies in an oil bath of at least 730° C.;

tempering said quenched leaf at a temperature of 400° C.±10° C. immediately after quenching to stabilize said internal structure of said leaf to obtain 120–180 kg/mm$^2$ initial tensile strength;

shot peening the surface of the tension side of said tempered leaf to obtain specified residual compressive stress; and performing said steps of first heating to tempering continuously in sequence.

5. A method of manufacturing a steel leaf spring, comprising the steps of:

heating a long strip in a continuous furnace for 5–10 minutes at 900° C.±25° C.;

rolling said heated strip successively at 870° C.±25° C. in a width direction thereof, thereafter at 850° C.±25° C. in a thickness direction thereof to obtain specified dimensions having reduced thickness in a range of 10%–60%;

cutting, piercing and stamping successively said rolled strip;

heating, in a second heating step, said cut-off leaf up to 850° C.±20° C.;

bending said reheated leaf for obtaining a specified shape;

heating, in a third reheating step, said bended leaf up to 850° C.±20° C.;

cambering said heated bended leaf by pressing in specified dies;

quenching said cambered leaf as pressed in said dies in an oil bath of at least 730° C.;

tempering said quenched leaf at a temperature of 400° C.±10° C. immediately after quenching to stabilize said internal structure of said leaf to obtain 120–180 kg/mm$^2$ initial tensile strength;

shot peening the surface of the tension side of said tempered leaf to obtain specified residual compressive stress; and performing said steps of heating, in a first heating step, to tempering continuously.

6. A method of manufacturing a steel leaf spring having eye-formed ends, comprising the steps of:

heating, in a first heating step, a long strip in a continuous furnace for 5–10 minutes at 900° C.±25° C.;

rolling said heated strip successively at 870° C.±25° C. in a width direction thereof, thereafter at 850° C.±25° C. in a thickness direction thereof to obtain specified dimensions having reduced thickness in a range of 10%–60%;

cutting said rolled strip, bending both tips of said cut leaf for shaping eyes, and piercing said bended leaf successively;

heating, in a second heating step, said worked leaf to a temperature of 850° C.±20° C.;

forming eyes on first and second ends of said reheated leaf;

heating, in a third reheating step, said eye formed leaf to a temperature of 850° C.±20° C.;

cambering said heated leaf by pressing in specified dies;

quenching said cambered leaf as pressed in said dies in an oil bath having a temperature of at least 730° C.;

tempering said quenched leaf at a temperature of 400° C.±10° C. immediately after quenching to stabilize said internal structure of said leaf to obtain 120–180 kg/mm$^2$ initial tensile strength;

shot peening the surface of the tension side of said tempered leaf to obtain specified residual compressive stress; and performing said steps from first heating to tempering continuously.

7. A method of manufacturing steel leaf spring as claimed in claim 1, wherein said quenching step is altered to quenching in a water bath from at least 680° C.

8. A method of manufacturing steel leaf spring as claimed in claim 2, wherein said quenching step is altered to quenching in a water bath from at least 680° C.

9. A method of manufacturing steel leaf spring as claimed in claim 3, wherein said quenching step is altered to quenching in a water bath from at least 680° C.

10. A method of manufacturing steel leaf spring as claimed in claim 4, wherein said quenching step is altered to quenching in a water bath from at least 680° C.

11. A method of manufacturing steel leaf spring as claimed in claim 5, wherein said quenching step is altered to quenching in a water bath from at least 680° C.

12. A method of manufacturing steel leaf spring as claimed in claim 6, wherein said quenching step is altered to quenching in a water bath from at least 680° C.

* * * * *